US008959888B2

(12) United States Patent
Laster et al.

(10) Patent No.: US 8,959,888 B2
(45) Date of Patent: Feb. 24, 2015

(54) DEVICE TO LOWER NOX IN A GAS TURBINE ENGINE COMBUSTION SYSTEM

(75) Inventors: Walter R. Laster, Oviedo, FL (US); Reinhard Schilp, Orlando, FL (US); David J. Wiebe, Orlando, FL (US)

(73) Assignee: Siemens Energy, Inc., Orlando, FL (US)

( * ) Notice: Subject to any disclaimer, the term of this patent is extended or adjusted under 35 U.S.C. 154(b) by 547 days.

(21) Appl. No.: 13/305,120

(22) Filed: Nov. 28, 2011

(65) Prior Publication Data

US 2013/0133330 A1 May 30, 2013

(51) Int. Cl.
*F02C 7/08* (2006.01)
*F02C 1/00* (2006.01)

(52) U.S. Cl.
USPC ..... 60/39.52; 60/755

(58) Field of Classification Search
USPC ..... 60/39.52, 39.5, 752–760
See application file for complete search history.

(56) References Cited

U.S. PATENT DOCUMENTS

| | | | | |
|---|---|---|---|---|
| 3,684,054 | A * | 8/1972 | Lemmerman | 181/203 |
| 3,785,145 | A | 1/1974 | Amann | |
| 3,851,467 | A | 12/1974 | Sherman et al. | |
| 3,874,166 | A * | 4/1975 | Kirchhofer et al. | 60/772 |
| 3,899,923 | A * | 8/1975 | Teller | 73/116.03 |
| 3,927,958 | A * | 12/1975 | Quinn | 431/116 |
| 4,271,664 | A | 6/1981 | Earnest | |
| 4,683,715 | A | 8/1987 | Iizuka et al. | |
| 4,721,454 | A | 1/1988 | Schirmer et al. | |
| 6,408,833 | B1 | 6/2002 | Faletti | |
| 7,305,831 | B2 | 12/2007 | Carrea et al. | |
| 7,721,547 | B2 | 5/2010 | Bancalari et al. | |
| 2004/0160061 | A1 | 8/2004 | Rouse et al. | |
| 2005/0235649 | A1 | 10/2005 | Baer et al. | |
| 2009/0205334 | A1 | 8/2009 | Aljabari et al. | |
| 2010/0003123 | A1 | 1/2010 | Smith | |
| 2010/0037617 | A1 | 2/2010 | Charron et al. | |
| 2010/0077719 | A1 | 4/2010 | Wilson et al. | |
| 2011/0016878 | A1 | 1/2011 | Berry | |
| 2013/0340404 | A1 * | 12/2013 | Hughes | 60/39.52 |

FOREIGN PATENT DOCUMENTS

| | | | |
|---|---|---|---|
| GB | 2024402 | A | 1/1980 |

* cited by examiner

*Primary Examiner* — Gerald L Sung

(57) ABSTRACT

An emissions control system for a gas turbine engine including a flow-directing structure (24) that delivers combustion gases (22) from a burner (32) to a turbine. The emissions control system includes: a conduit (48) configured to establish fluid communication between compressed air (22) and the combustion gases within the flow-directing structure (24). The compressed air (22) is disposed at a location upstream of a combustor head-end and exhibits an intermediate static pressure less than a static pressure of the combustion gases within the combustor (14). During operation of the gas turbine engine a pressure difference between the intermediate static pressure and a static pressure of the combustion gases within the flow-directing structure (24) is effective to generate a fluid flow through the conduit (48).

19 Claims, 3 Drawing Sheets

DEVICE TO LOWER NOX IN A GAS TURBINE ENGINE COMBUSTION SYSTEM

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

FIELD OF THE INVENTION

The invention relates to an emissions control system for a gas turbine engine. More particularly, this invention relates to an emissions control system that utilizes differences in static pressure within the gas turbine engine to generate fluid flows that reduce the formation of oxides of nitrogen (NOx) and carbon monoxide (CO).

BACKGROUND OF THE INVENTION

High efficiency gas turbine engine combustors operate at high temperatures that may produce an unacceptable level of NOx emissions. One technique for reducing the formation of NOx includes recirculating a portion of the spent combustion gases back into the combustor. The presence of the recirculated vitiated gases reduces the amount of oxygen available for combustion. This reduces the temperature of combustion, which in turn reduces NOx formation. The vitiated air may also contain unburned hydrocarbons, and these are burned upon reintroduction into the combustor.

Conventional recirculation employs equipment such as fans and blowers. This equipment may add to the cost and maintenance of a gas turbine engine. Furthermore, when such equipment is connected through a casing of the gas turbine engine, the cost of the casing and the potential for leakage increase. Jets may be employed as part of the burner within the combustor to accomplish exhaust gas recirculation. However, the jets increase the pressure drop across the burner which limits their application. Consequently, there is room in the art for improvement.

BRIEF DESCRIPTION OF THE DRAWINGS

The invention is explained in the following description in view of the drawings that show.

DETAILED DESCRIPTION OF THE INVENTION

Figure 1:
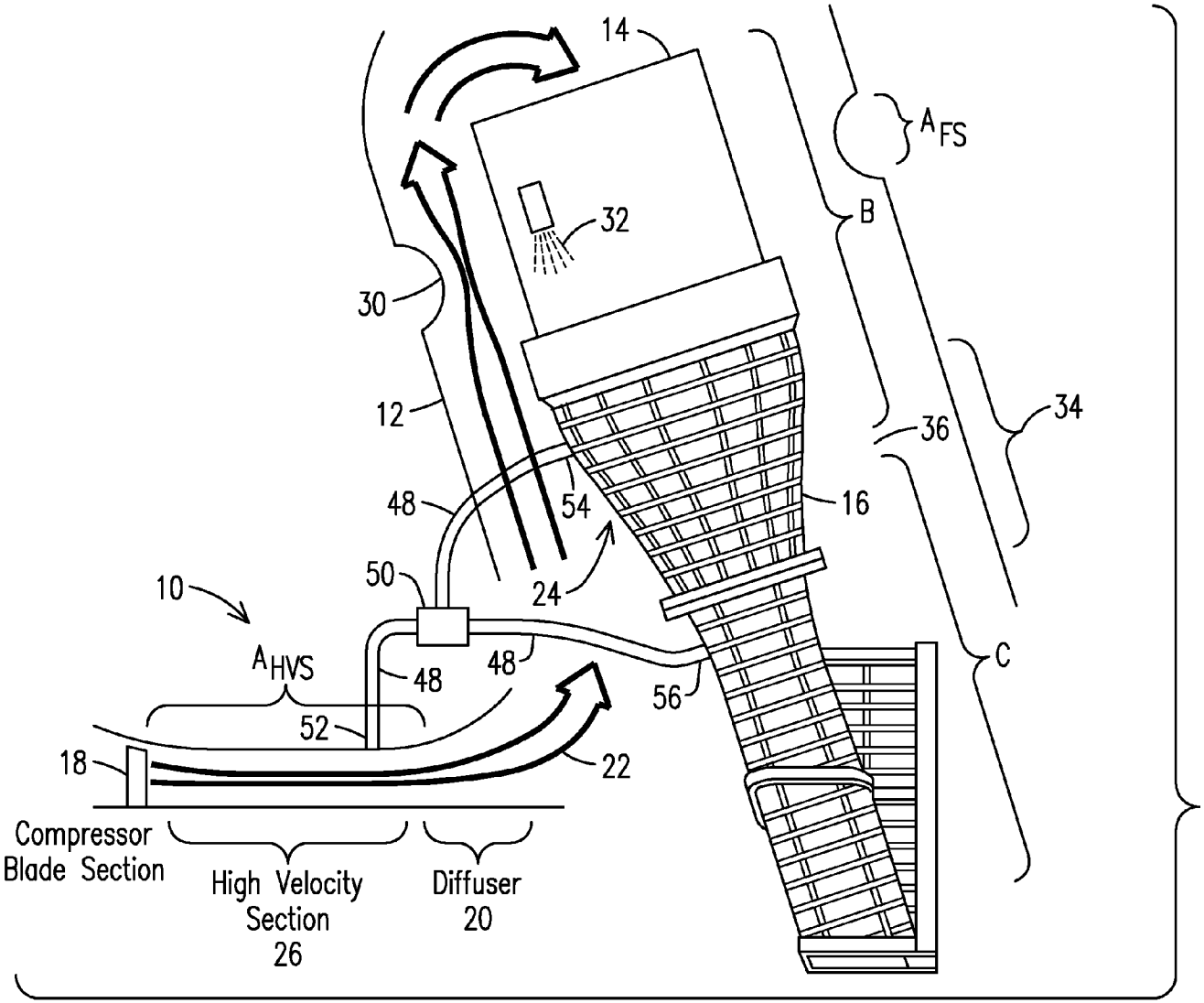
FIG. 1 is a schematic representation of a gas turbine engine from a compressor to the turbine showing an exemplary embodiment of the conduit.

Fluids flowing through a gas turbine engine flow at varying speeds and as a result, these fluids experience varying static pressures throughout the gas turbine engine. As used herein, the term "fluids" includes compressed air up to the burner, and combustion gases from the burners on. The present inventors have recognized that in a conventional gas turbine engine with a combustor, a transition, and a first stage vane section, compressed air at a location upstream of the combustor may exhibit a static pressure below that of a static pressure of the combustion gases within the combustor and the transition. This may be so for combustion gases at any location along an entire length of the combustor and the transition.

In advanced transition designs a gas turbine engine may have an advanced design duct that directs the combustion gases from the combustor to the first row of turbine blades. The advanced design duct is configured to properly align the combustion gases and may comprise a gas accelerating structure that accelerates the combustion gases to an appropriate speed for delivery to the first row of turbine blades. In these advanced transition designs, the inventors have also realized that at some downstream point in the flow of combustion gases, a speed of the flow is increased enough to reduce a static pressure exhibited by the flow of combustion gases at that point to below that of the static pressure exhibited by the compressed air at the location upstream of the combustor.

As used herein, a flow directing structure is considered to be the structure that directs combustion gases from a point where combustion is initiated to the first row of turbine blades. Thus, in gas turbine engines using advanced transition designs, a static pressure exhibited by the fluid at a location upstream of the combustor, (i.e. an intermediate static pressure), will be in-between a static pressure exhibited by combustion gases at a relatively upstream location within the flow directing structure, (i.e. a relatively high static pressure), and a static pressure exhibited by combustion gases at a relatively downstream location within the flow directing structure, (i.e. a relatively low static pressure). The intermediate static pressure need not be a specific static pressure; it simply needs to be below a relatively higher static pressure exhibited by combustion gases within the flow directing structure. If there is a range of static pressures exhibited below the relatively higher static pressure exhibited by combustion gases within the flow directing structure, then the intermediate static pressure can be any selected static pressure within that range.

All gas turbine engines will have combustion gases exhibiting a static pressure within the flow directing structure that is greater than the intermediate static pressure exhibited by the compressed air. However, in conventional gas turbine engines the flow of combustion gases is not accelerated to the same degree as within the advanced transition designs. Consequently, conventional gas turbine engines may not have a location of relatively low static pressure. For consistency, the term intermediate static pressure will be used as a reference hence forth to describe a static pressure exhibited at a location within the compressed air regardless of whether or not there is a location of relatively low static pressure. Consequently, in a conventional gas turbine engine there will be a location in the compressed air exhibiting an intermediate static pressure, and a location within the flow directing structure exhibiting a relatively higher static pressure.

The present inventors have thus recognized a location with gas turbine engines where the compressed air naturally exhibits an intermediate static pressure that is less than a static pressure exhibited by combustion gases within the flow directing structure. Further, the inventors have recognized a way to utilize this phenomenon to reduce emissions, and still further, the inventors have devised a way to artificially create a location in the compressed air that will exhibit an intermediate static pressure.

Reducing emissions includes reducing NOx emissions which increase as flame temperature increases. One technique for reducing NOx emissions is to recirculate a portion of spent combustion gases (i.e. vitiated air) from the flow directing structure back into the inlet of the combustion system. Until now this recirculation has required externally powered mechanism to generate the recirculation, or a jet disposed within the burner. The innovative method disclosed herein takes advantage of the now-recognized favorable static pressure differences to enable this recirculation of vitiated air without any need for external mechanism or a jet disposed in a burner. Specifically, the present invention includes establishing fluid communication between the location in the compressed air exhibiting the intermediate static pressure, and a location in the combustion gases within the flow directing structure exhibiting a greater static pressure. The fluid communication can be established by a simple conduit, there may be a valve used to control the flow, and the conduit may be sized or contain an orifice etc. to meet flow requirements. Once the appropriate conduit is established, the greater static pressure exhibited by the combustion gases within the flow directing structure will naturally redirect a portion of the combustion gases from the flow directing structure toward the location in the compressed air exhibiting the lower static pressure. Once there, the redirected portion of the combustion gases enters the stream of compressed air feeding the combustor.

Reducing emissions also includes reducing CO emissions which increase as the flame temperature decreases. One technique for reducing CO emissions is to bypass a portion of the compressed air around the combustion inlet and introduce it into the flow directing structure downstream of the combustion. In gas turbine engines where the combustion gases exhibit a relatively lower static pressure, establishing fluid communication between the compressed air at the intermediate static pressure and the combustion gases at the relatively low static pressure will enable a portion of the compressed air at the intermediate static pressure to bypass the combustor and enter the flow directing structure downstream of the combustion. Here again, the fluid communication may be established by a conduit between the two locations. The conduit may have a valve and may be appropriately sized or contain an orifice etc. to control the fluid flow.

Either one or both of the NOx and CO emissions reducing system described above may implemented on a single gas turbine engine. In embodiments where both are employed, they may be combined into a single system. For example, the conduit may be connected to the intermediate static pressure location, the relatively high static pressure location, and the relatively low static pressure location. A valve may be employed to selectively permit a first fluid communication path between the intermediate static pressure location and the relatively high static pressure location, or a second fluid communication path between the intermediate static pressure location and the relatively low static pressure location. In such a configuration the first fluid communication path may be established during base load operation when NOx production is problematic, and the second communication path may be established during part load operation when CO production is problematic.

In another embodiment, a conduit may be connected at one end to the intermediate static pressure location and at another end the conduit may be selectively positionable between the relatively high static pressure location and the relatively low static pressure location. The selection may be accomplished by a flexible conduit and structure that permits the other end to be moved between the high static pressure location and the relatively low static pressure location. In this configuration the system is again selectively positionable between the intermediate static pressure location and the relatively high and the relatively low static pressure locations.

The location in the compressed air exhibiting an intermediate static pressure may be a location where the intermediate static pressure is a natural result of other gas turbine engine design considerations. Since it is known that there exists a relationship between a fluid's velocity and a fluid's static pressure, compressed air exhibiting a very high total pressure may exhibit a low static pressure when traveling at this high speed. This may happen at a point where a flow path constricts. Such a constriction may be naturally present in a compressor at a location where the compressed air is traveling relatively fast. This may occur approximately between the last (i.e. most downstream) row of blades and the diffuser, though these boundaries are flexible. In this embodiment an end of the conduit seeking the intermediate static pressure may be connected to this high-speed section of the compressor.

Alternately, structure may be implemented that creates an intermediate pressure within the compressed air. In an embodiment, a flow sleeve that surrounds a flow directing structure may include a structure analogous to a venturi that accelerates a flow of compressed air between the flow sleeve and the flow directing structure such that the compressed air within the accelerated region exhibits the intermediate static pressure. In this embodiment an end of the conduit seeking the intermediate static pressure may be connected to the venturi structure. An advantage to such an embodiment is that relative motion between the flow direction structure and the flow sleeve is minimal since both are commonly supported. In contrast, in an embodiment where the conduit is disposed between the flow directing structure and the compressor, relative movement between the flow directing structure and the compressor may be a source of mechanical stress for the conduit and associated fittings and connection points because the flow directing structure and the compressor are not commonly supported.

Figure 2:
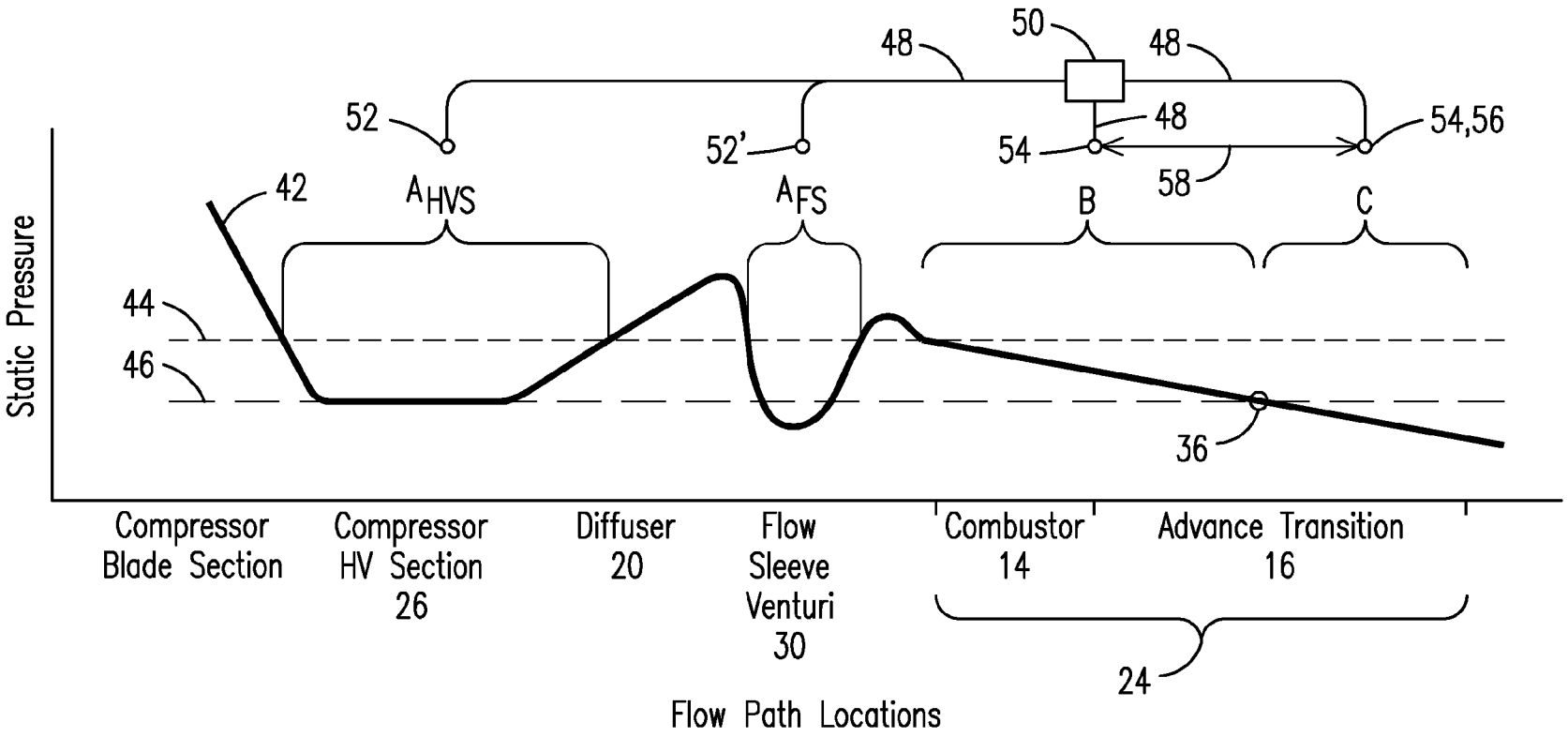
FIG. 2 is a graph of static pressure at different locations within the gas turbine engine components of FIG. 1.
Figure 3:
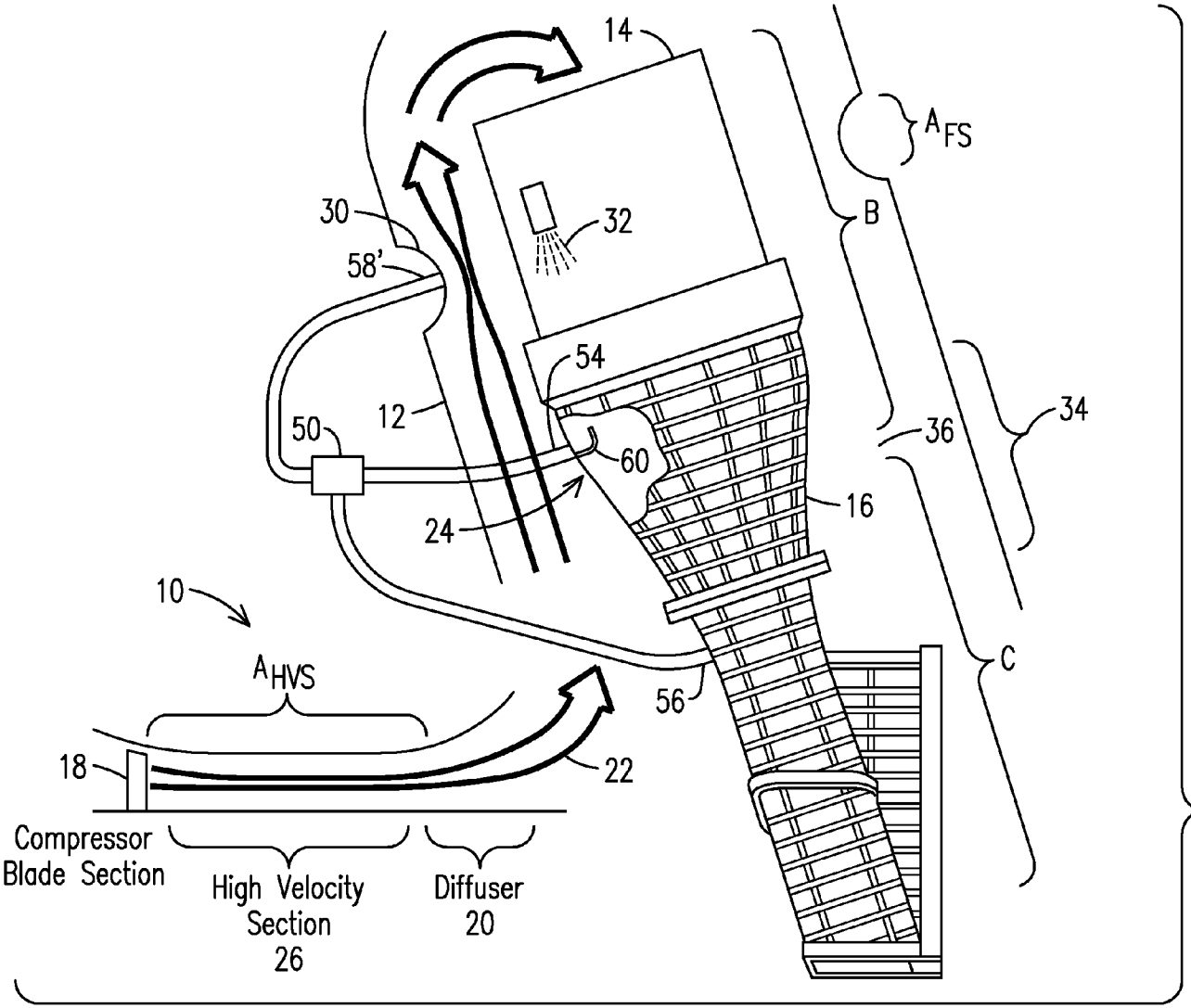
FIG. 3 is a schematic representation of a gas turbine engine from a compressor to the turbine showing an alternate exemplary embodiment of the conduit.

Turning to the drawings, FIGS. 1-3 schematically show a compressor 10, a flow sleeve 12, a combustor 14, and an advanced transition 16. Within the compressor is a last row of compressor blades 18, a diffuser 20, and a high velocity section 26 between the last row of compressor blades 18 and the diffuser 20. The flow directing structure 24 comprises the advanced transition 16 and the combustor 14. The advanced transition 16 comprises a gas accelerating structure 34 indicated generally. Compressed air 22 is compressed by the compressor blades, travels at a high velocity through the high velocity section 26, and enters the diffuser 20 where it slows down. It then travels between the flow sleeve 12 and flow directing structure 24 and then into the combustor 14. Compressed air 22 exhibits an intermediate static pressure naturally at a location within the high velocity section 26. However, the compressed air 22 may exhibit the intermediate static pressure within a small portion of the high velocity section 26, or also upstream of and/or slightly downstream of the high velocity section 26. Consequently, location range $A_{HVS}$ is used to denote the range of locations in the compressor 10 where the compressed air 22 may exhibit the intermediate static pressure.

In an embodiment where an additional structure is utilized to create the intermediate static pressure, the flow sleeve 12 may comprise a venturi-like structure 30 configured to accelerate the compressed air 22 such that compressed air 22 within the venturi-like structure 30 exhibits the intermediate pressure. However, the compressed air 22 may exhibit the intermediate static pressure within a small portion of the venturi-like structure 30, or the compressed air 22 may also exhibit the intermediate static pressure upstream of and/or slightly downstream of the venturi-like structure 30. Consequently, location range $A_{FS}$ is used to denote the range of locations along the flow sleeve 12 where the compressed air 22 may exhibit the intermediate static pressure.

Once in the combustor 14 the compressed air is mixed with fuel and ignited at the burner 32, and this generates the combustion gases. The combustor 14 enables the combustion and serves to direct the combustion gases part of the way to the first row of turbine blades. For this reason the combustor 14 together with the advanced transition 16 are considered the flow directing structure 24 from which combustion gases may be extracted. Upon exiting the combustor 14 the combustion gases enter the advanced transition 16. The advanced transition 16 includes a gas accelerating structure 34 indicated generally. The gas accelerating structure 34 accelerates the combustion gases from approximately 0.2 mach to a speed appropriate for delivery to the first row of turbine blades, which may be approximately 0.8 mach. Consequently, in this embodiment a static pressure of the combustion gases decreases significantly as the combustion gases travel downstream. Since static pressure exhibited by the combustion gases at a relatively upstream location is above the intermediate static pressure, and at relatively downstream the static pressure exhibited is below the intermediate static pressure, there is a transition point 36 within the flow directing structure 24 where the combustion gases exhibit a transition point static pressure that is the same as the intermediate static pressure that is selected. Location range "B" is used to denote the range of locations in the flow directing structure 24 where the combustion gases may exhibit the relatively high static pressure. Likewise, location range "C" is used to denote the range of locations in the flow directing structure 24 where the combustion gases may exhibit the relatively low static pressure.

Thus, in order to establish fluid communication such that a portion of the combustion gases will flow from the flow directing structure 24 to the intermediate static pressure location upstream of the combustor 14 as a result of static pressure differences, the conduit could be connected on one end within the static pressure location ranges $A_{HVS}$, $A_{FS}$ and the second end could be connected within the flow directing structure 24 location range B, since the static pressure within the flow directing structure 24 within location range B will be greater than the intermediate static pressure. Likewise, in order to establish fluid communication such that a portion of the combustion gases will flow from the intermediate static pressure location to the flow directing structure 24 as a result of static pressure differences, the conduit could be connected on one end within the static pressure location ranges $A_{HVS}$, $A_{FS}$ and the second end could be connected to the flow directing structure 24 location range C, since the static pressure within location range C will be less than the intermediate static pressure.

The transition point 36 is only indicated conceptually, and not intended to indicate an exact position where the transition point 36 is location. The transition point may be more than a point, but may be a span, depending on the configuration of the advanced transition 16 etc. Further, it may be more upstream or more downstream than indicated. Likewise, the location range B and the location range C are indicated only conceptually, and are not meant to imply the exact locations where these static pressures may be found. Each may be larger or smaller, and ends that abut the transition point 36 may be shifted upstream or downstream relative to how they are schematically depicted in the figures.

It is understood that the intermediate static pressure, the relatively high static pressure, and the relatively low static pressures may vary during operation due to any number of factors, including percent of operational load, and transients etc. Should the intermediate static pressure fluctuate more so than either the relatively high static pressure and/or the relatively low static pressure, the connection points must then be chosen to accommodate these relative fluctuations without reversing the flow direction in the conduit. Specifically, the farther upstream within the location range B the conduit is disposed, the greater the pressure difference between the relatively high static pressure and the intermediate static pressure. A greater difference permits the intermediate static pressure to move closer to the relatively high static pressure without surpassing it. Likewise, the farther downstream within the location range "C", the greater the amount the intermediate static pressure can decrease while still being greater than the relatively low static pressure.

In an embodiment where both paths are incorporated into a single system, one end of the conduit could be connected within the static pressure location ranges $A_{HVS}$, $A_{FS}$, a second end could be connected within the flow directing structure 24 location range B, and a third end could be connected to the flow directing structure 24 location range C. A valve 50 could be utilized to permit the selection of desired flow path. Alternately, a positioning mechanism could be utilized that permits on end of the conduit to be selectively positioned between location range B and location range C. In an alternate embodiment, two separate conduits could be utilized, one for each flow path, and each selectively allowed to permit respective fluid communication.

FIG. 2 depicts conceptually a static pressure profile 42 exhibited by the fluid, be it compressed air or combustion gases at various locations within the gas turbine engine. Dotted line 44 indicates the highest static pressure present within the flow directing structure 24. The intermediate static pressure must be below the highest static pressure 44. In this figure the intermediate static pressure selected is the lowest static pressure present within the compressor high velocity section. Dotted line 46 indicates the intermediate static pressure, and the location where it intersects the static pressure profile within the flow directing structure indicates the transition point 36 in the flow directing structure. It can be seen that any location within the flow directing structure 24 upstream of the transition point will exhibit a greater static pressure than the selected intermediate static pressure. Likewise, any location within the flow directing structure 24 downstream of the transition point will exhibit a lesser static pressure. It can also be seen in location range ranges $A_{HVS}$, $A_{FS}$, the intermediate static pressure need not be the lowest static pressure available. For example, any pressure present within location ranges $A_{HVS}$, $A_{FS}$ but below the highest static pressure 44 could be selected as the intermediate static pressure. Changing the selection of intermediate static pressure simply changes where the transition point 36 occurs within the flow directing structure 24.

In order to establish fluid communication for a selected intermediate static pressure, one simply needs to ascertain an intermediate static pressure location in the gas turbine engine where the selected static pressure exists. The intermediate static pressure location will be in either location range $A_{HVS}$, or $A_{FS}$. One can then connect a first end 52, 52' respectively of the conduit to intermediate static pressure location, depending on which location range is chosen. Likewise, in order to establish fluid communication with the relatively high static pressure combustion gases one simply needs to select a desired relatively high static pressure, determine a relatively high static pressure location within range B (above the transition point) where this occurs, and connect a second end 54 of the conduit 48 to the flow directing structure 24 at the relatively high static pressure location. The same process applies if fluid communication is desired with combustion gases exhibiting relatively low static pressure. One simply needs to select a desired relatively low static pressure, determine a relatively low static pressure location within range C (below the transition point) where this occurs, and connect a either the second end 54 of the conduit 48 or a third end 56 of the conduit 48 to the flow directing structure 24 at the relatively low static pressure location. Alternately, a positioning mechanism 58 could be used to shift a second end 54 of the conduit 48 between the relatively high static pressure location and the relatively low static pressure location.

As can be seen in FIG. 3, a scoop 60 may be disposed within the combustion gases and configured to direct the combustion gases into the conduit. The scoop may be disposed such that it is effective to direct the combustion gases comprising a relatively high concentration of NOx based on a NOx profile of a cross section of a flow of the combustion gases perpendicular to a direction of flow of the combustion gases.

In an innovative adaptation the inventors have devised a clever yet simple way to take advantage of a newly-recognized inherent static pressure differences to simplify emission reduction. The inventors have expanded the ways this concept can be implemented by devising a unique way to emulate the inherent pressure difference but in a different location. As a result, with a system as simple as a single conduit, NOx and/or CO emissions can be reduced. Thus, this system represents an improvement in the art.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. An emissions control system for a gas turbine engine comprising a flow-directing structure that delivers combustion gases from a burner to a turbine, wherein a static pressure exhibited by combustion gasses within the flow-directing structure varies from relatively high at a relatively upstream location to relatively low at a relatively downstream location, the emissions control system comprising:

a conduit configured to establish fluid communication between;

a) compressed air exhibiting an intermediate static pressure that is less than a static pressure of combustion gases at an upstream location within the flow directing structure, and an upstream location that is at either 1) a high-velocity section of a compressor where the compressed air comprises the intermediate static pressure, or 2) at a constricted region defined by a flow sleeve and a combustor wall and configured to produce a venturi effective to generate the intermediate static pressure, and b) the combustion gases within the flow-directing structure;

wherein during operation of the gas turbine engine, a pressure difference between the intermediate static pressure and the static pressure of combustion gases within the flow-directing structure is effective to generate a fluid flow through the conduit.

2. The emissions control system of claim 1, wherein the flow-directing structure comprises the combustor wall and a transition duct, wherein the pressure difference generates the fluid flow in the conduit from the flow-directing structure to the compressed air upstream location, the fluid flow comprising a portion of the combustion gases.

3. The emissions control system of claim 2, wherein the conduit establishes fluid communication with the combustion gases at a location within a volume of the combustion gases comprising a relatively high concentration of NOx based on a NOx profile of a cross section of a flow of the combustion gases perpendicular to a direction of flow of the combustion gases.

4. The emissions control system of claim 1, wherein the flow-directing structure comprises the combustor wall and a duct, and wherein the duct comprises a combustion gas accelerating structure configured to accelerate the combustion gases to a speed that is sufficient to create a static pressure at a downstream location in the flow-directing structure that is less than the intermediate static pressure.

5. The emissions control system of claim 4, wherein the conduit establishes fluid communication between the compressed air at the upstream location and the combustion gases at the flow-directing structure upstream location, and wherein the fluid flow travels from the flow-directing structure upstream location to the compressed air upstream location and comprises a portion of the combustion gases.

6. The emissions control system of claim 4, wherein the flow-directing structure upstream location is also disposed within a volume of the combustion gases comprising a relatively high concentration of NOx based on a NOx profile of a cross section of a flow of the combustion gases perpendicular to a direction of flow of the combustion gases.

7. The emissions control system of claim 4, wherein the conduit establishes fluid communication between the compressed air at the upstream location and the combustion gases at the flow-directing structure downstream location, and wherein the fluid flow travels from the combustion air upstream location to the flow-directing structure downstream location and comprises a portion of the compressed air.

8. The emissions control system of claim 4, wherein the conduit is configured to enable selection between a first fluid communication path between the compressed air at the compressed air upstream location and the combustion gases at the flow-directing structure upstream location wherein the fluid flow travels from the flow-directing structure upstream location to the compressed air upstream location and comprises a portion of the combustion gases, and a second fluid communication path between the compressed air at the compressed air upstream location and the combustion gases at the flow-directing structure downstream location wherein the fluid flow travels from the compressed air upstream location to the flow-directing structure downstream location and comprises a portion of the compressed air.

9. A gas turbine engine comprising the emissions control system of claim 1.

10. An emissions control system for a gas turbine engine comprising a combustor comprising a burner and a flow-directing structure that delivers combustion gases from the burner to a turbine, the emissions control system comprising:

a conduit configured to establish fluid communication between combustion gases within the flow-directing structure and compressed air at a constricted portion of a compressed air flow path upstream of a head-end of the combustor, wherein the compressed air flow path is defined by a flow sleeve and the combustor, and wherein a portion of the flow sleeve around a combustor wall forms the constricted portion;

wherein during operation of the gas turbine engine, the constricted portion accelerates the compressed air which is effective to reduce a static pressure exhibited by the compressed air within the constricted portion to less than a static pressure exhibited by the combustion gases at an upstream location within the flow directing structure; and wherein a pressure difference between the compressed air in the constricted portion and combustion gases within the flow-directing structure is effective to generate a fluid flow through the conduit.

11. The emissions control system of claim 10, wherein the flow-directing structure comprises the combustor wall and a transition duct, wherein the pressure difference generates the fluid flow in the conduit from the flow-directing structure to the constricted portion, the fluid flow comprising a portion of the combustion gases.

12. The emissions control system of claim 11, comprising a scoop disposed within the combustion gases and configured to direct the combustion gases into the conduit.

13. The emissions control system of claim 12, wherein the scoop is disposed such that the scoop is effective to direct the combustion gases comprising a relatively high concentration of NOx based on a NOx profile of a cross section of a flow of the combustion gases perpendicular to a direction of flow of the combustion gases.

14. The emissions control system of claim 10, wherein the flow-directing structure comprises the combustor wall and a duct, wherein the duct comprises a combustion gas accelerating structure configured to accelerate the combustion gases, and wherein at a downstream location in the flow-directing structure the combustion gasses exhibit a static pressure less than the static pressure exhibited by the compressed air within the constricted portion.

15. The emissions control system of claim 14, wherein the conduit establishes fluid communication between the compressed air within the constricted portion and the combustion gases at the flow-directing structure upstream location.

16. The emissions control system of claim 14, wherein the conduit establishes fluid communication between the compressed air within the constricted portion and the combustion gases at the flow-directing structure downstream location.

17. The emissions control system of claim 14, wherein the conduit is configured to enable selection between a first fluid communication path between the compressed air at the constricted portion and the combustion gases at flow-directing structure upstream location, and a second fluid communication path between the compressed air at the constricted portion and the combustion gases at the flow-directing structure upstream location.

18. The emissions control system of claim 10, wherein the flow sleeve and the combustor are commonly supported so as to move together during operation of the gas turbine engine.

19. A gas turbine engine comprising the emissions control system of claim 10.

* * * * *